US008908895B2

(12) United States Patent
Würfel

(10) Patent No.: US 8,908,895 B2
(45) **Date of Patent: *Dec. 9, 2014**

(54) EAR CANAL DEVICE RETENTION MEANS

(75) Inventor: Claus Würfel, Smørum (DK)

(73) Assignee: Oticon A/S, Smorum (DK)

( * ) Notice: Subject to any disclaimer, the term of this patent is extended or adjusted under 35 U.S.C. 154(b) by 65 days.

This patent is subject to a terminal disclaimer.

(21) Appl. No.: 13/426,156

(22) Filed: Mar. 21, 2012

(65) Prior Publication Data

US 2012/0177242 A1 Jul. 12, 2012

Related U.S. Application Data

(63) Continuation of application No. 11/653,443, filed on Jan. 16, 2007, now Pat. No. 8,184,841.

(30) Foreign Application Priority Data

Jan. 19, 2006 (EP) ..... 06100599

(51) Int. Cl.
*H04R 25/00* (2006.01)
*H04R 1/10* (2006.01)

(52) U.S. Cl.
CPC ..... *H04R 25/656* (2013.01); *H04R 2225/025* (2013.01); *H04R 1/105* (2013.01); *H04R 2460/09* (2013.01); *H04R 25/556* (2013.01); *H04R 1/1058* (2013.01)
USPC ..... 381/328; 381/329; 381/380; 381/382; 181/130; 181/135

(58) Field of Classification Search
CPC ..... H04R 1/10; H04R 1/105; H04R 25/02; H04R 25/60; H04R 25/65; H04R 2225/023
USPC ..... 381/380, 328–329, 382; 181/130, 135
See application file for complete search history.

(56) References Cited

U.S. PATENT DOCUMENTS

| | | | | |
|---|---|---|---|---|
| 5,282,253 | A | 1/1994 | Konomi et al. | |
| 6,055,319 | A | 4/2000 | Shennib et al. | |
| 6,819,762 | B2 * | 11/2004 | Jones et al. | 379/430 |
| 7,058,951 | B2 * | 6/2006 | Bril et al. | 718/104 |
| 7,068,803 | B2 * | 6/2006 | Kuhlmann et al. | 381/328 |
| 7,379,557 | B2 | 5/2008 | Chou | |
| 7,421,086 | B2 | 9/2008 | Bauman et al. | |
| 7,590,255 | B2 | 9/2009 | Nielsen | |
| 7,720,244 | B2 | 5/2010 | Espersen et al. | |

(Continued)

FOREIGN PATENT DOCUMENTS

EP 1377113 1/2004

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

The invention regards an ear canal device and a retainer strip, whereby the ear canal device has a distal part for extending into the ear canal and facing the tympanic membrane and a proximal part extending towards the ear canal opening, wherein the proximal part of the ear canal device comprises an opening extending transversely through the ear canal device, and where a retaining strip is arranged with a first end thereof arranged to be fastened in the opening and a second end arranged to lie resiliently against the inside of the concha for exerting a retaining force on the ear canal device.

22 Claims, 5 Drawing Sheets

(56) References Cited

U.S. PATENT DOCUMENTS

| | | | | |
|---|---|---|---|---|
| 7,841,446 | B2 * | 11/2010 | Leong et al. | 181/135 |
| 7,899,200 | B2 * | 3/2011 | Karamuk et al. | 381/328 |
| 8,331,596 | B2 * | 12/2012 | Topholm et al. | 381/330 |
| 8,374,367 | B2 * | 2/2013 | Nielsen et al. | 381/313 |
| 8,374,375 | B2 * | 2/2013 | Hu | 381/380 |
| 2008/0144877 | A1 * | 6/2008 | Ham et al. | 381/379 |
| 2009/0092269 | A1 | 4/2009 | Nielsen et al. | |

* cited by examiner

EAR CANAL DEVICE RETENTION MEANS

This application is a Continuation of application Ser. No. 11/653,443, filed on Jan. 16, 2007 now U.S. Pat. No. 8,184,841, and for which priority is claimed under 35 U.S.C. §120. This application claims priority of EP Application No. 06100599.7 filed on Jan. 19, 2006, respectively, under 35 U.S.C. §119; the entire contents of each of the above applications is hereby incorporated by reference.

AREA OF THE INVENTION

The invention regards a device for retaining a non-custom unit within the ear canal. Non-custom units comprise among others receiver units and tube positioning units, which are to be retained at a predetermined point of insertion within the ear canal in order to deliver a sound signal to the tympanic membrane. Also attenuation devices which are placed in the ear and protect the ear against overly loud sounds and which are used by musicians and others may benefit from the invention.

BACKGROUND OF THE INVENTION

Since the ear canal has a tendency to narrow down from entry towards the ear drum, a device attached to the unit placed in the ear, capable of applying an inward force towards the ear drum is desired. Knowing the fact that ear canals differ from person to person, the problem may not be so pronounced for all users, which makes it desirable that this device is detachable.

In a prior art patent application DE 20 2004 016 540A1 by Bruckhoff a solution is disclosed. However the presented solution is not very handy when it comes to choosing between a device having the retaining means and one without. It is therefore an object of the invention to provide a retention device, which can easily be attached to or detached from an ear canal device, and whereby the connection between the ear canal device and the retaining means is stable and immobile.

SUMMARY OF THE INVENTION

The idea is to have a strip-bendable piece of plastic, which can be placed in the ear piece unit by sliding it through an opening. When the strip is placed in the ear concha and fixed in the bend position, reaction forces in the plastic will try to straighten the strip again and hereby apply the desired inward force to the ear canal.

According to the invention an ear canal device and a retainer strip is provided, whereby the ear canal device has a distal part for extending into the ear canal and facing the tympanic membrane and a proximal part extending towards the ear canal opening, wherein the proximal part of the ear canal device comprises an opening, and where a retaining strip is arranged with a first end thereof arranged to be fastened in the opening and a second end arranged to lie resiliently against the inside of the concha for exerting a retaining force on the ear canal device.

By this construction the strip is easily attached or removed according to the users needs. No other part of the system needs to be taken apart in order to remove or install the strip. The opening in the canal device can easily be provided, and when not in use, because the user is not in need of a retainer strip, the opening will be hidden at the entrance of the ear canal and will not normally be visible.

In an embodiment the strip has a cross-section which matches the opening and a knob is formed at one end of the strip and further the opening is through going. This allows the strip to be fastened securely to the ear canal device by being drawn through the opening from one end thereof such that the knob will form an end stop. This is a particularly simple and efficient way of securing the strip in the opening. Preferably the canal device has a recess around the opening whereby the knob will be flush with the canal device.

The opening in the proximal part of the ear canal device can be provided as a through going transverse canal. Also the opening may be formed as a slit, which allows the retaining strip to be inserted sideways into the opening.

In an embodiment the strip near the knob and/or the opening is angled with respect to the length direction of the canal device such that the strip will be angled outwardly from the ear canal once the canal device and strip are arranged within the ear canal. Such an outwardly angled strip will give a better holding force and will especially ensure a force towards the ear canal.

In an embodiment the strip has an oval cross section. When the strip is made from a resilient material, and the oval cross section will provide a uniform force against the inside of the concha and thereby the device will also be comfortable to wear.

DESCRIPTION OF A PREFERRED EMBODIMENT

Figure 1:
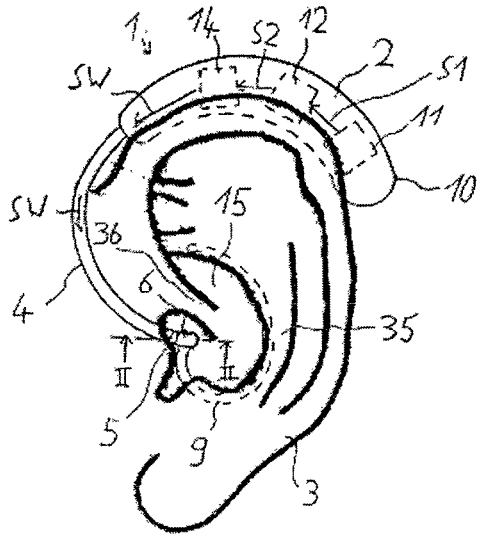
Fig. 1 (Prior art)
FIG. 1 displays a prior art device when placed in the ear.
Figure 2:
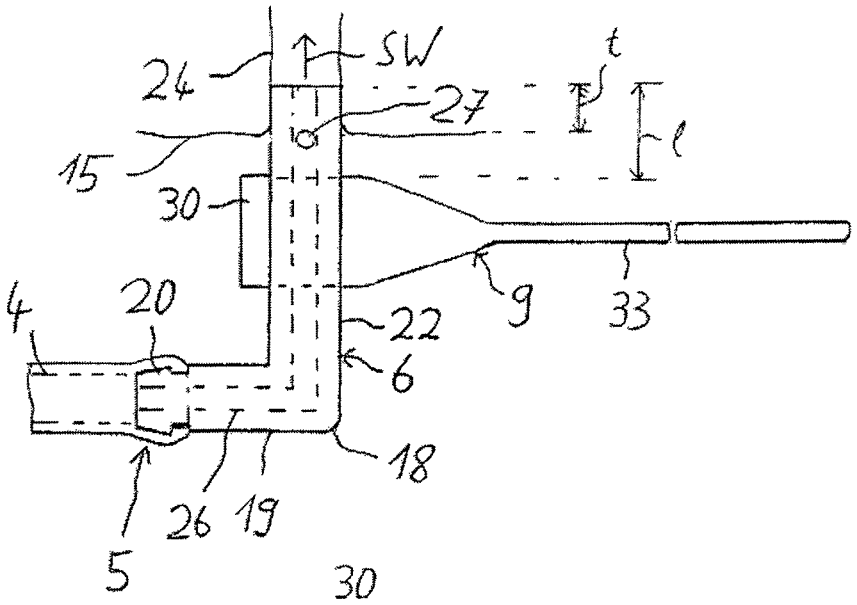
Fig. 2 (Prior art)
FIG. 2 displays a detail of a prior art device.
Figure 3:
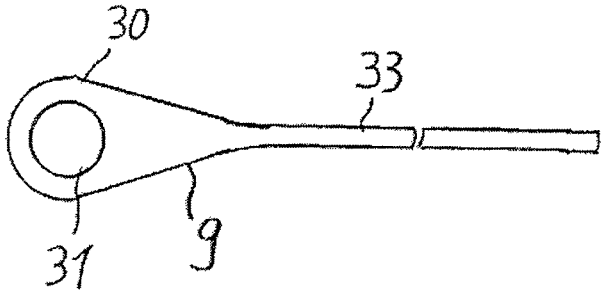
Fig. 3 (Prior art)
FIG. 3 displays a strip according to the prior art.

A prior art solution is disclosed in FIGS. 1-3. This solution is known from DE 20 2004 016 540A1 by Bruckhoff. According to the solution a strip like element 33 (best seen in FIG. 2) is fastened to the ear canal device and caused to lie flat against the lover and back-facing part of the concha, whereby the resilience of the strip 33 exerts a force on the ear canal device, which aids to keep the device in place, also during vigorous movement of the head. As seen in FIGS. 2 and 3 the strip 33 has a wider portion 30 at one end thereof with a hole 31 passing through the wider portion. The ear canal device in this case is a tube 22 and as seen in FIG. 2 the tube is caused to pass through the hole 31 and in this fashion the strip is fastened to the ear canal device. The problem in relation to this solution is that the ear canal device has to be taken apart and detached from a behind the ear part, before the tube 22 can be drawn through the hole 31. This is a rather cumbersome task, and further it makes the strip voluminous especially at the end with the hole, and this makes the strip less in-conspicuous. Further the connection between the hole 31 and the tube 22 allows the strip to rotate around the tube 22 which may cause the strip to become mis-placed during normal use and a good deal of dexterity is needed if the user wants to place it rightly again.

Thus a holding means is requested which is easily removed from the ear canal device and which will form an immobile connection with the ear canal device once fastened thereto.

Figure 4:
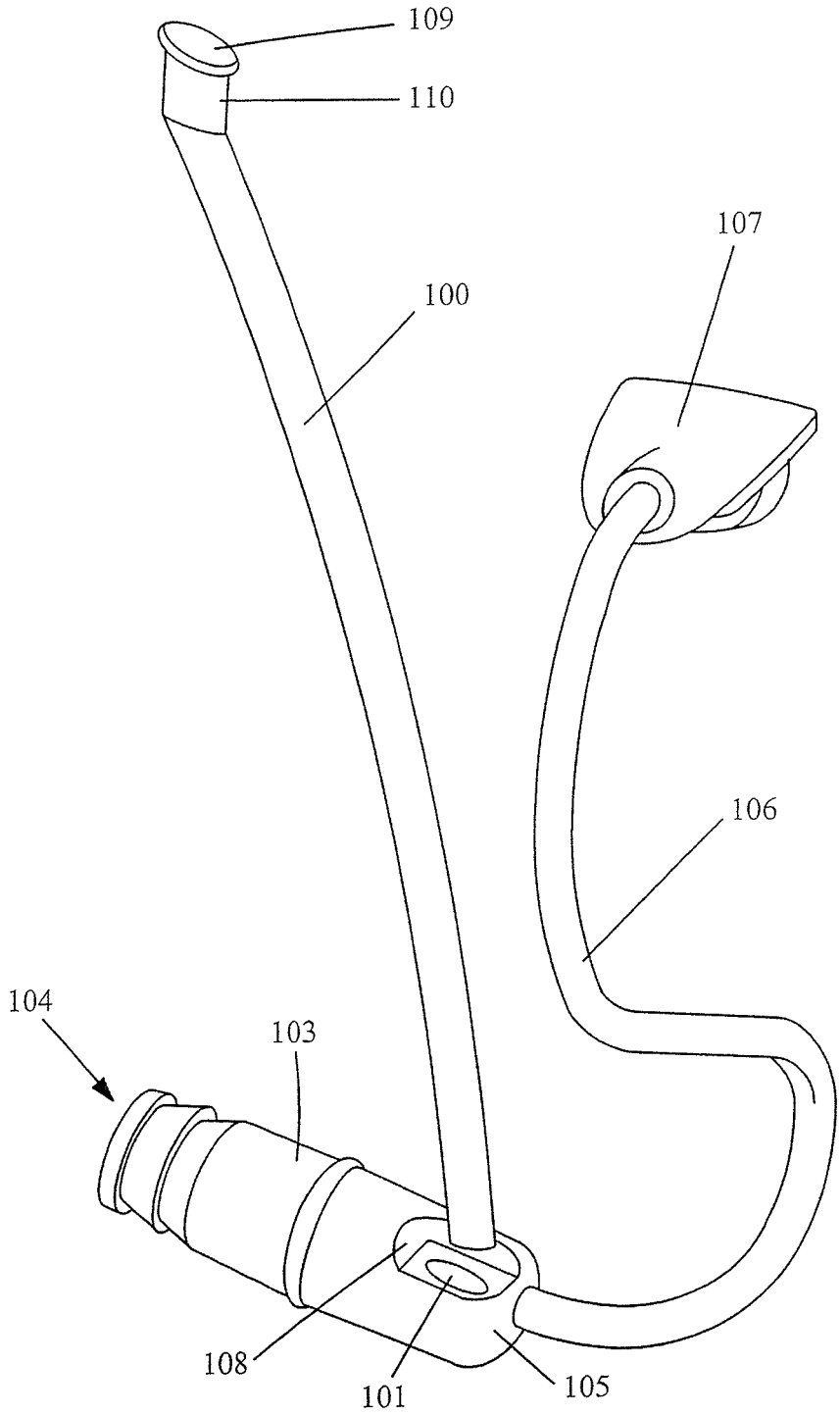
FIG. 4 displays an ear canal device retainer and ear canal device according to the present invention.

An example of the invention is shown in FIG. 4. Here the strip 100 is shown above the opening 101 ready for insertion into the opening 101. The ear canal device 103 in the example is a receiver assembly which has an opening 104 at the end supposed to face the tympanic membrane when placed in the ear, and where the ear canal device 103 is coupled to a wire 106 at the opposite end. The wire end 106 will be placed at the entrance of the ear canal when the device is inserted into the ear canal. The wire 106 has a connection part 107 at its other end for connection with a hearing aid (not shown). Usually such a hearing aid would be placed above the ear lobe.

Around the opening 101 a recess 108 is arranged, and the strip 100 has at its end part a small knob 109 which fits into the recess 108 when the strip 100 is drawn through the opening 101.

In the embodiment shown in FIG. 4 the strip is supposed to be inserted into the opening 101, drawn through the opening 101 and pulled tight such that the knob 109 is seated in the recess 108. By making the part of the strip just below the knob 109 with a cross section which fits tightly into the opening 101 it is ensured that the strip is maintained in position fixed to the ear canal device 103. As further seen in FIG. 4 the section 110 of the strip 100 just below the knob 109 is angled slightly with respect to the remainder of the strip. This aids to position the strip 100 rightly inside the concha when in place.

The strip 100 may be straight or slightly curved and made from a resilient material, such that it may be placed against the inside of the concha as shown in the prior art in FIG. 1. The resilience of the material will ensure that a uniform force between the strip material and the concha will be maintained throughout the length of the strip and a reasonable reaction force will be applied to the canal device 103 in order to maintain the device 103 inside the ear canal at its proper position.

Figure 5:
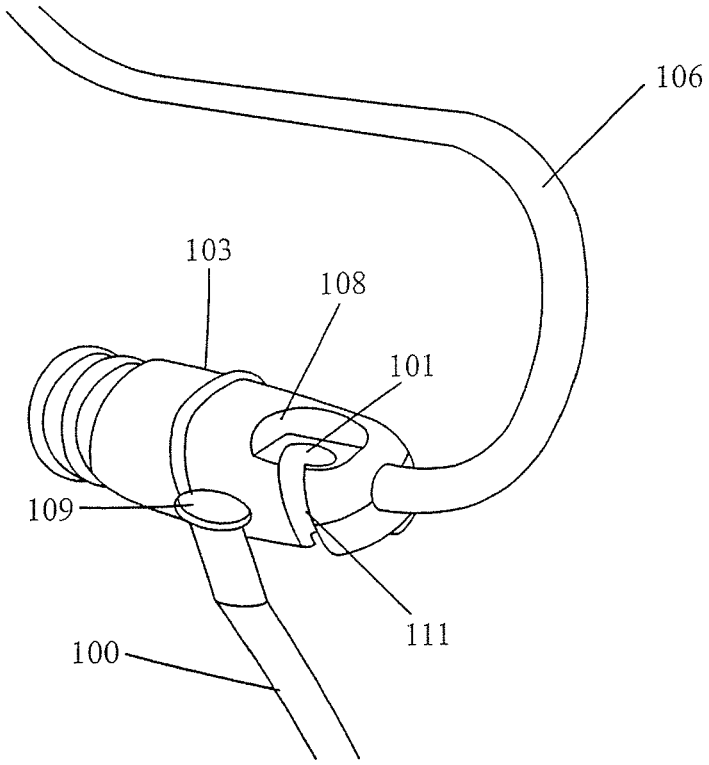
FIG. 5 displays a further embodiment of the invention.

In a further embodiment displayed in FIG. 5 the opening 101 is a slit 111 extending transversely of the ear canal device 103. The strip 100 can in this case be moved sideways into the slit 111 and seated here or moved into the opening 101 from above as indicated in FIG. 4. In either case the strip will be seated in the opening such that the knob part 109 will be seated in the recess 108 and end in a position more or less flush with the outside surface of the ear canal device.

Figure 6:
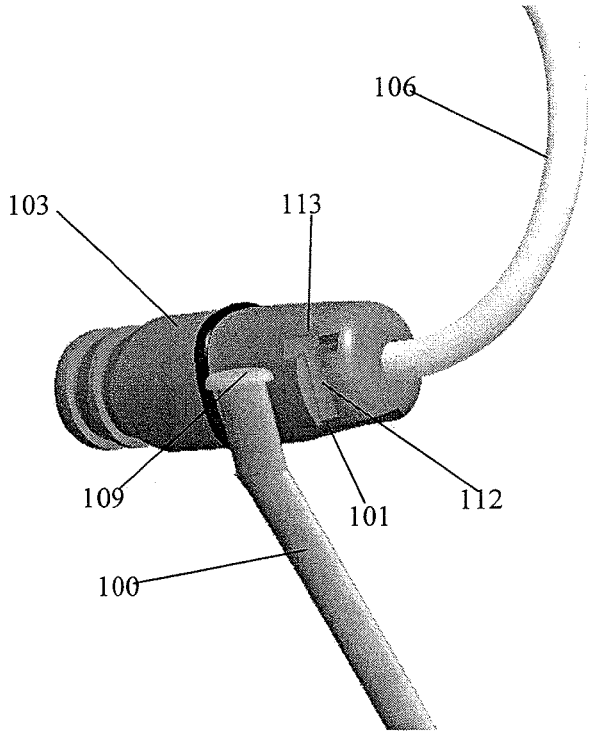
FIG. 6 displays yet another embodiment of the invention.

In FIG. 6 a further embodiment is shown. Here the opening 101 is a blind opening with a recess 113 at the bottom thereof. The wider part 113 is made in order to accommodate the knob part 109. In this case the strip 100 is introduced into the opening 101 either from below or from the side. In either case the knob part 109 will click into place in the recess 113 at the bottom of the blind opening 101, and hereby the strip 100 is maintained in safe manner and immobilized with respect to the ear canal device 103.

In the above examples the knob part is shown as a flat flange terminating the strip, but the knob may also be drop shaped or have some other shape which secures the strip against being pulled out of the opening 101.

In the disclosed embodiment of the invention the canal device is a receiver assembly, but many other canal devices could be maintained in the ear canal by a retaining means according to the invention. In a hearing aid device the receiver could be placed in a cabinet behind the ear, and a sound tube could provide the sound signal to the ear canal, whereby a sound tube retainer device is used. Here the strip could be used as described to keep the sound tube in place in the ear canal. Apart from in hearing aids as described above the invention may also be used in connection with sound attenuation devices used to protect the ear against loud sounds or in ear communication devices used to provide communication between a telephone or another communication device and an ear canal device.

The invention claimed is:

1. An ear canal device, comprising:

a distal part for extending into an ear canal and facing a tympanic membrane;

a proximal part extending towards an opening of the ear canal where the ear canal device is coupled to one end of a wire, where the wire has a connection part at its other end, the proximal part including an opening configured to receive a retainer strip and fasten the retainer strip relative to the proximal part; and the retainer strip inserted into said opening of the proximal part, the retainer strip including a first end configured to be fastened in the opening, and a second end configured to lie resiliently against the inside of a concha to exert a retaining force on the ear canal device, wherein the second end of the retainer strip is slidably inserted from one open end of the opening to another open end of the opening to a position where a widening knob on the first end of the retainer strip is in contact with an edge of the one open end of the opening.

2. The ear canal device according to claim 1, wherein the retainer strip has a cross-section which has a shape substantially the same as the shape of the opening of the proximal part.

3. The ear canal device according to claim 2, wherein the retainer strip has an oval cross-section.

4. The ear canal device according to claim 1, wherein the opening is a duct with two open ends through the proximal part.

5. The ear canal device according to claim 1, further comprising:

a recess around a first open end of the opening accommodating the widening knob on the first end of the retainer strip and keeping the widening knob flush with the ear canal device.

6. The ear canal device according to claim 1, wherein the retainer strip includes:

an elongate body, the elongate body including a corner closer to the first end than the second end of the retainer strip.

7. The ear canal device according to claim 6, wherein a distance from the first end to the corner is substantially equal to a depth of the opening through the proximal part.

8. The ear canal device according to claim 1, further comprising:

a rib surrounding an end of the distal part.

9. The ear canal device according to claim 1, further comprising:

a receiver housed within the ear canal device.

10. An ear canal device, comprising:

a distal part for extending into an ear canal and facing a tympanic membrane;

a proximal part extending towards an opening of the ear canal, the proximal part including an opening configured to receive a retainer strip and fasten the retainer strip relative to the proximal part; and the retainer strip inserted into said opening of the proximal part, the retainer strip including a first end configured to be fastened in the opening, a second end configured to lie resiliently against the inside of a concha to exert a retaining force on the ear canal device, and a widened portion at an end of the first end, wherein the second end of the retainer strip is slidably inserted from one open end of the opening to another open end of the opening, and the widened portion on the first end of the retainer strip prevents the retainer strip from completely passing through the opening.

11. The ear canal device according to claim 10, wherein the widened portion forms an end stop.

12. The ear canal device according to claim 10, wherein the shape of the retainer strip matches the opening.

13. An ear canal device, comprising:

a distal part for extending into an ear canal and facing a tympanic membrane;

a proximal part extending towards an opening of the ear canal, the proximal part including an opening configured to receive a retainer strip and fasten the retainer strip relative to the proximal part; and the retainer strip inserted into said opening of the proximal part, the retainer strip including a first end configured to be fastened in the opening, a second end configured to lie resiliently against the inside of a concha to exert a retaining force on the ear canal device, and a widened portion at an end of the first end, wherein the retainer strip is slidably inserted in the opening, a narrowed portion, narrower than the widened portion, is provided adjacent to the widened portion, and a transition between the narrowed portion and the widened portion is configured to match a recessed surface part of the opening.

14. The ear canal device according to claim 13, wherein the shape of the retainer strip matches the opening.

15. An ear canal device, comprising:

a distal part for extending into an ear canal and facing a tympanic membrane; and a proximal part extending towards an opening of the ear canal, the proximal part of the ear canal device including an opening configured to receive a physically detached retainer strip and fasten the retainer strip relative to the proximal part, wherein the retainer strip has a first end thereof arranged to be fastened in the opening and a second end arranged to lie resiliently against the inside of a concha for exerting a retaining force on the ear canal device.

16. The ear canal device according to claim 15, wherein the retainer strip has a cross-section which has a shape substantially the same as the shape of the opening, the retainer strip includes a widening knob formed at the first end of the retainer strip, and the opening is a duct with two open ends through the proximal part.

17. The ear canal device according to claim 16, wherein the retainer strip adjacent to the widening knob and/or the opening is angled with respect to the length direction of the ear canal device such that the strip is angled outwardly from the ear canal once the ear canal device and retainer strip are arranged within the ear canal.

18. The ear canal device according to claim 16, wherein the retainer strip has an oval cross-section.

19. The ear canal device according to claim 15, wherein the opening is a blind hole or a slit with a widened part at the bottom thereof.

20. The ear canal device according to claim 15, further comprising:

a recess around a first open end of said opening configured to receive the retainer strip, the recess accommodating a widening knob of the retainer strip flush with the ear canal device.

21. The ear canal device according to claim 20, further comprising:

a rib surrounding an end of the distal part; and a recess adjacent said rib.

22. The ear canal device according to claim 15, wherein the proximal part is substantially cylindrical.

* * * * *